US011041596B1

(12) United States Patent
Zhang

(10) Patent No.: US 11,041,596 B1
(45) Date of Patent: Jun. 22, 2021

(54) MUSIC ARCTIC STARRY SKY LAMP

(71) Applicant: Yingping Zhang, Guangdong (CN)

(72) Inventor: Yingping Zhang, Guangdong (CN)

( * ) Notice: Subject to any disclaimer, the term of this patent is extended or adjusted under 35 U.S.C. 154(b) by 0 days.

(21) Appl. No.: 17/170,011

(22) Filed: Feb. 8, 2021

(30) Foreign Application Priority Data

Jan. 14, 2021 (CN) ..... 202120093180.8

(51) Int. Cl.

| | |
|---|---|
| ***F21S 10/00*** | (2006.01) |
| ***F21V 5/04*** | (2006.01) |
| ***F21V 17/12*** | (2006.01) |
| ***H04R 1/02*** | (2006.01) |
| ***F21V 3/04*** | (2018.01) |
| ***F21V 14/06*** | (2006.01) |
| ***F21V 33/00*** | (2006.01) |

(52) U.S. Cl.
CPC ..... *F21S 10/00* (2013.01); *F21V 3/049* (2013.01); *F21V 5/04* (2013.01); *F21V 14/06* (2013.01); *F21V 17/12* (2013.01); *F21V 33/0056* (2013.01); *H04R 1/028* (2013.01)

(58) Field of Classification Search
CPC ..... H04R 1/028; F21S 10/00; F21V 3/049; F21V 5/04; F21V 14/06; F21V 17/12; F21V 33/0056
See application file for complete search history.

(56) References Cited

U.S. PATENT DOCUMENTS

| | | | | | |
|---|---|---|---|---|---|
| 57,602 | A * | 8/1866 | Warden | F21V 21/30 | 362/269 |
| 2,341,223 | A * | 2/1944 | Lillie | G09F 19/18 | 353/62 |
| 3,978,598 | A * | 9/1976 | Rose | F21S 10/04 | 40/428 |
| 4,779,176 | A * | 10/1988 | Bornhorst | G03B 15/02 | 353/62 |
| 4,817,163 | A * | 3/1989 | Stastny | A63J 17/00 | 181/148 |
| 6,350,042 | B1 * | 2/2002 | Lai | F21V 17/02 | 353/62 |
| 8,714,799 | B2 * | 5/2014 | Chien | F21V 23/04 | 362/555 |
| 10,353,211 | B1 * | 7/2019 | Zhang | G02B 27/0955 | |
| 10,859,221 | B2 * | 12/2020 | Chien | F21K 9/232 | |

(Continued)

*Primary Examiner* — Arman B Fallahkhair
(74) *Attorney, Agent, or Firm* — Muncy, Geissler, Olds and Lowe, P.C.

(57) ABSTRACT

The invention discloses a music arctic starry sky lamp comprising a shell assembly, an auroral assembly arranged in the shell assembly and a laser assembly arranged in the shell assembly; the auroral assembly comprises an auroral cover, an auroral piece, a condensing lens, a lens mount, a substrate and a motor arranged from top to bottom; a plurality of irregular plano-convex lenses are arranged on said auroral cover, the number of which is not less than ten, and not less than two thirds of the irregular plano-convex lenses are irregular long-strip-shaped lenses, and the length of the side edge of each irregular long-strip-shaped lens is more than two times of the width thereof; a plurality of plano-convex lenses are arranged on said auroral piece, different in size and irregular in shape, and the focal lengths thereof are different and the size are smaller than the diameter of the condensing lenses.

5 Claims, 4 Drawing Sheets

(56) References Cited

U.S. PATENT DOCUMENTS

| | | | | |
|---|---|---|---|---|
| 2015/0131288 | A1* | 5/2015 | Zhang | F21S 8/00 362/277 |
| 2015/0159842 | A1* | 6/2015 | Zhang | F21S 10/06 362/231 |
| 2016/0026073 | A1* | 1/2016 | Zhang | G03B 21/142 353/101 |
| 2017/0219176 | A1* | 8/2017 | Chang | F21V 21/0824 |
| 2018/0283663 | A1* | 10/2018 | Zhang | F21V 11/08 |

* cited by examiner

MUSIC ARCTIC STARRY SKY LAMP

BACKGROUND OF THE INVENTION

1. Field of the Invention

The invention relates to the field of a projection lamp equipment, specifically relating to a music arctic starry sky lamp.

2. Description of the Related Art

The starry sky projection lamp is a decorative lighting device which can project countless starry or snowflake patterns on walls, ceilings and lawns, can play a role in creating atmosphere and decorating landscape, having very wide application in life. At present, patterns projected by starry sky projection lamps in the market are mostly simple patterns such as stars and the like, the projection effect thereof is monotonous, failing to meet the requirements for active atmosphere of many occasions.

The technical problems reflected above are therefore problems to be solved urgently by those skilled in the art.

SUMMARY OF THE INVENTION

The invention aims at providing a music arctic starry sky lamp to solve problems of monotonous projection effect of the projection lamp and failure in simulating northern lights in prior art, so as to fill the vacancy on the market.

In order to realize the purpose, the following technical solution is adopted: a music arctic starry sky lamp comprises a shell assembly, an auroral assembly arranged in the shell assembly and a laser assembly arranged in the shell assembly;

Said auroral assembly comprises an auroral cover, an auroral piece, a condensing lens, a lens mount, a substrate and a motor which are arranged from top to bottom, said auroral cover is fixedly connected with the shell assembly via screws; said condensing lens is fixedly connected with the lens mount, which is fixedly connected with the substrate; lamp beads are arranged on said substrate, and said motor is fixedly connected with the substrate, and the output end of said motor penetrates through the substrate and is fixedly connected with the auroral piece;

A plurality of irregular plano-convex lenses are arranged on said auroral cover, the number of which is not less than ten, and not less than two thirds of the irregular plano-convex lenses are irregular long-strip-shaped lenses, and the length of the side edge of each irregular long-strip-shaped lens is more than two times of the width thereof;

A plurality of plano-convex lenses are arranged on said auroral piece, the plano-convex lenses are different in size and are irregular in shape, and the focal lengths of said plano-convex lenses are different and the size thereof are smaller than the diameter of the condensing lenses.

As an improvement, said shell assembly includes an upper shell and a bottom shell arranged in combination from top to bottom wherein the top surface of said upper shell is provided with an auroral through-hole penetratingly and said auroral through-hole and auroral cover are used in a cooperative manner; the top surface of said upper shell is provided with a laser through-hole penetratingly, and said laser through-hole and the laser assembly are used in a cooperative manner.

As an improvement, said laser assembly includes a grating piece, a laser, and a laser radiator provided from top to bottom wherein said grating piece and the upper shell are fixedly connected, said laser and the laser radiator are fixedly connected, and said laser radiator and the upper shell are fixedly connected.

As an improvement, a loudspeaker is arranged on said bottom shell, and said loudspeaker and the bottom shell are fixed via screws.

As an improvement, a mainboard is arranged on said bottom shell wherein the mainboard is electrically connected with the lamp beads, and is electrically connected with the laser, and is electrically connected with the loudspeaker.

Compared with the prior art, the invention has simulated the irregular light bands of northern lights and the effect of auroral stream to a great extent, added with starry lights and music, thereby restoring a fantastic romantic scene of the arctic starry sky.

Figure 1:
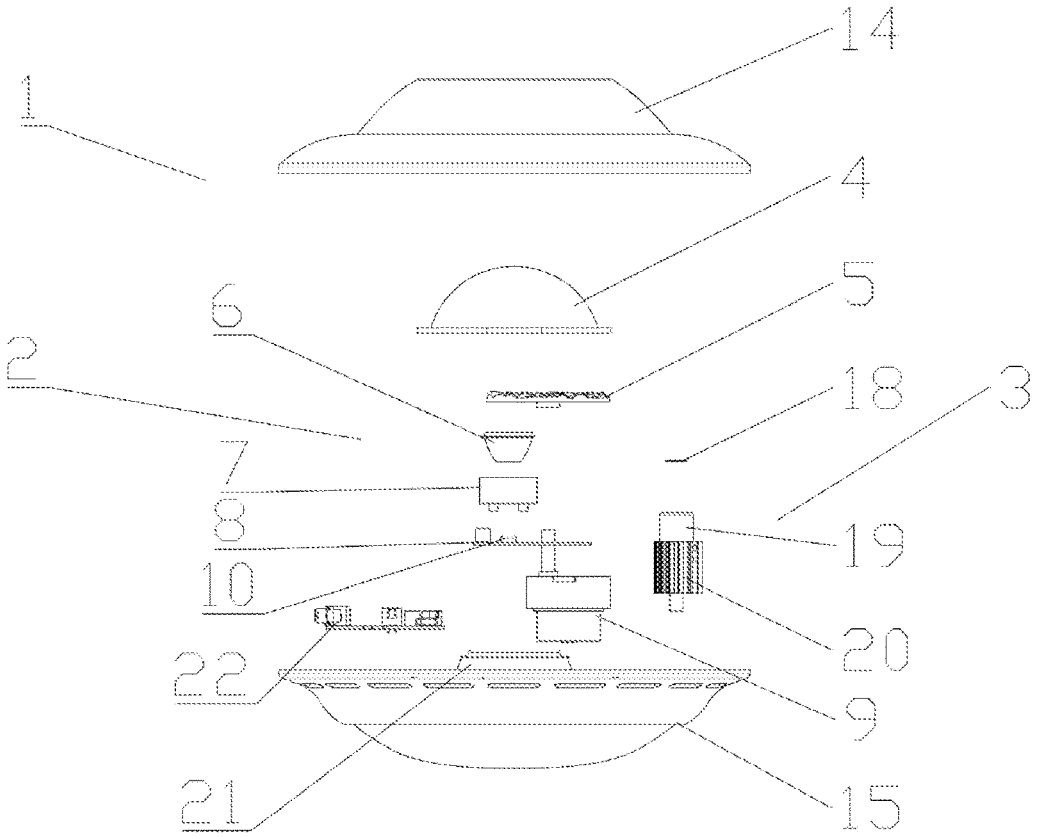
FIG. 1 is an explosion diagram illustrating the structure of the music arctic starry sky lamp of the invention.
Figure 2:
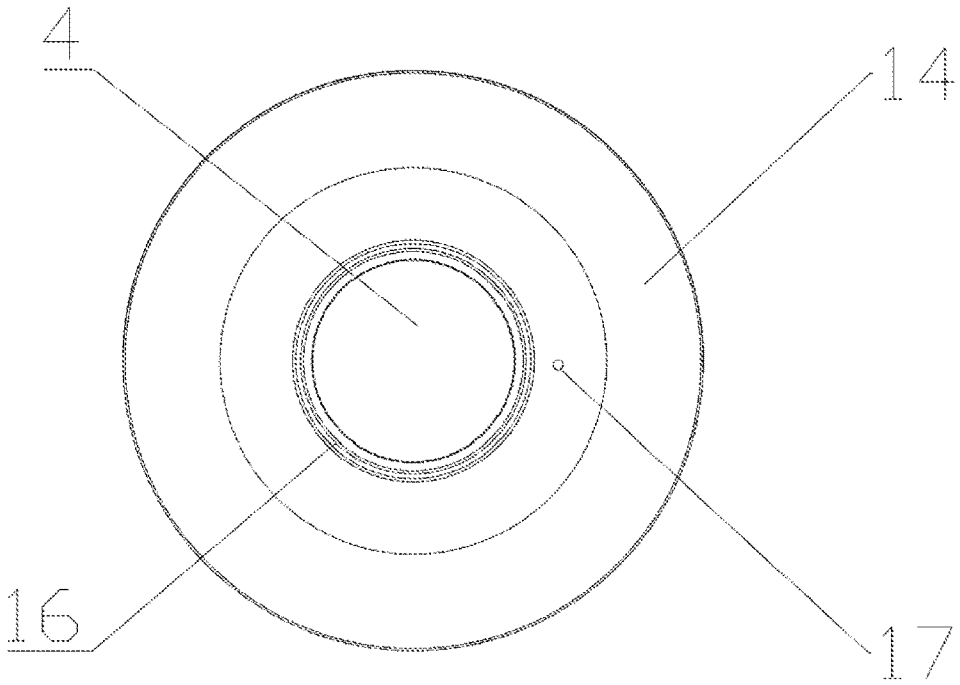
FIG. 2 is an explosion diagram illustrating the music arctic starry sky lamp with structural complementary visual angles.
Figure 3:
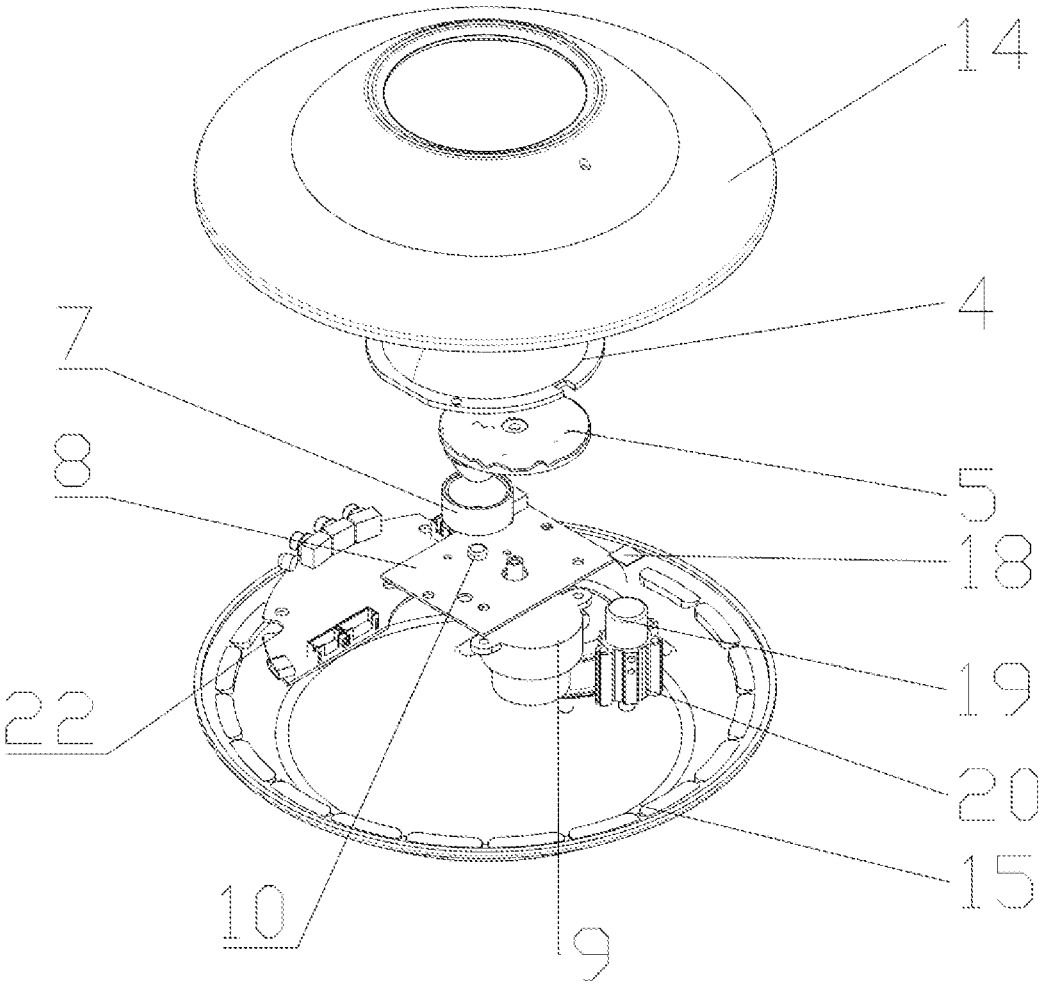
FIG. 3 is a top view of the music arctic starry sky lamp of the invention.
Figure 4:
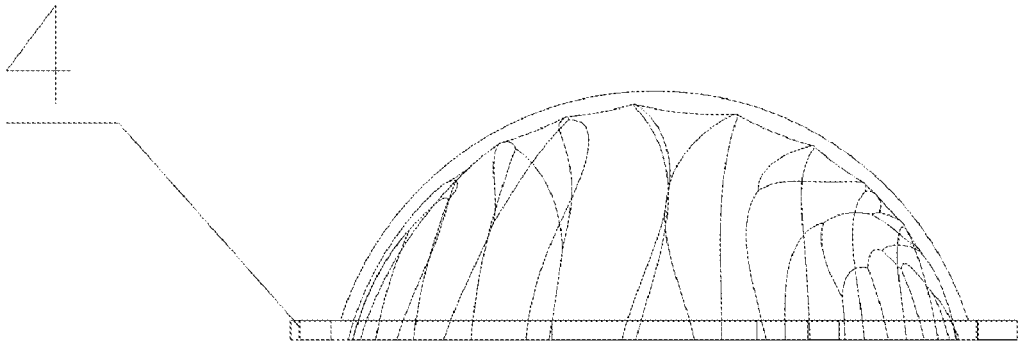
FIG. 4 is a front view of the auroral cover of the music arctic starry sky lamp of the invention.
Figure 5:
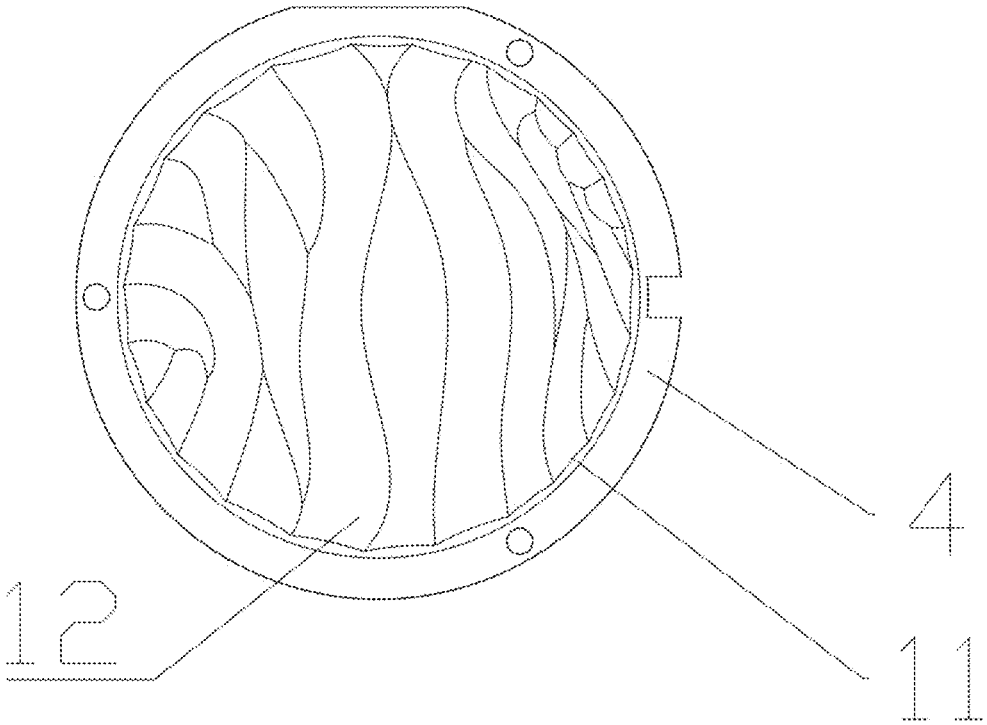
FIG. 5 is a bottom view of the auroral cover of the music arctic starry sky lamp of the invention.
Figure 6:
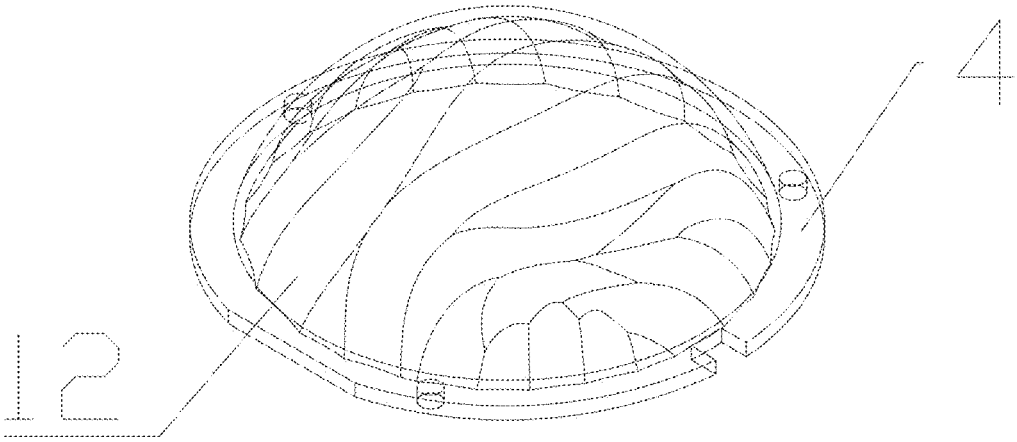
FIG. 6 is a perspective view of the auroral cover of the music arctic starry sky lamp of the invention.
Figure 7:
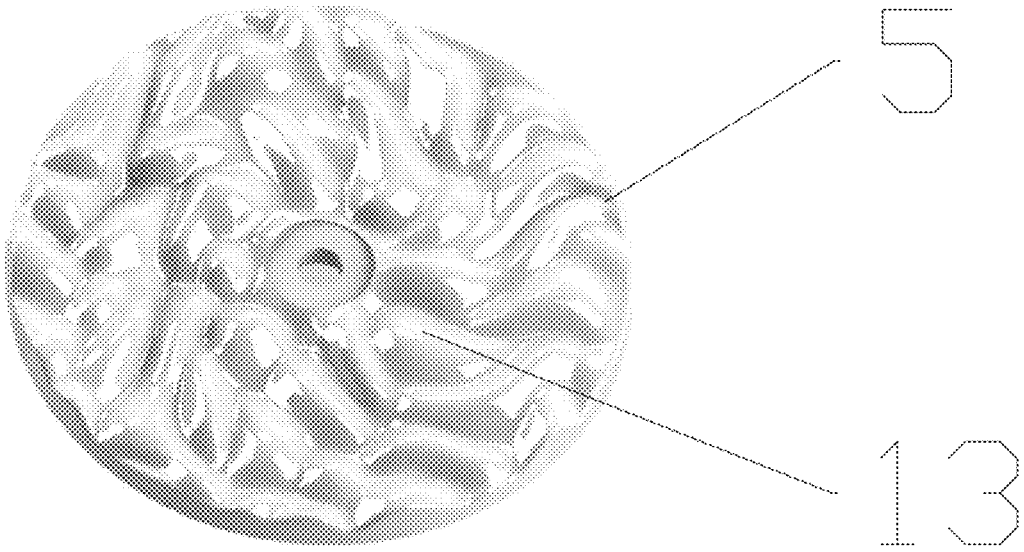
FIG. 7 is a rendering schematic diagram of the auroral piece of the music arctic starry sky lamp of the invention.

As is shown in drawings, 1. Shell assembly, 2. Auroral assembly, 3. Laser assembly, 4. Auroral cover, 5. Auroral piece, 6. Condensing lens, 7. Lens mount. 8. Substrate, 9. Motor, 10. Lamp beads, 11. Irregular plano-convex lenses, 12. Long-strip-shaped lenses, 13. Plano-convex lenses, 14. Upper shell, 15. Bottom shell, 16. Auroral through-hole, 17. Laser through-hole, 18. Grating piece, 19. Laser, 20. Laser radiator, 21. Loudspeaker, 22. Mainboard.

DETAILED DESCRIPTION OF THE PREFERRED EMBODIMENTS

The embodiment of the invention is further described in detail hereinafter, which are illustrated in the drawings, wherein identical or similar reference numerals refer to the same or similar elements or elements having the same or similar functions throughout. In the description of the invention, it should be understood that the terms "upper", "lower", "front", "rear", "left", "right", "inner", "outer", "vertical", "circumferential", and the like indicate orientations or positional relationships based on orientations or positional relationships shown in the drawings, and are only for convenience and simplification of description, but do not indicate or imply that the device or element referred to must have a specific orientation, be constructed and operated in a specific orientation, and thus, should not be construed as limiting the invention.

With reference to drawings 1 to 7, a music arctic starry sky lamp comprises a shell assembly 1, an auroral assembly 2 arranged in the shell assembly 1 and a laser assembly 3 arranged in the shell assembly 1;

Said auroral assembly 2 comprises an auroral cover 4, an auroral piece 5, a condensing lens 6, a lens mount 7, a substrate 8 and a motor 9 which are arranged from top to bottom, said auroral cover 4 is fixedly connected with the shell assembly 1 via screws; said condensing lens 6 is fixedly connected with the lens mount 7, which is fixedly connected with the substrate 8; lamp beads 10 are arranged on said substrate 8, and said motor 9 is fixedly connected with the substrate 8, and the output end of said motor 9 penetrates through the substrate 8 and is fixedly connected with the auroral piece 5;

A plurality of irregular plano-convex lenses 11 are arranged on said auroral cover 4, the number of which is not less than ten, and not less than two thirds of the irregular plano-convex lenses 11 are irregular long-strip-shaped lenses 12, and the length of the side edge of each irregular long-strip-shaped lens 12 is more than two times of the width thereof;

A plurality of plano-convex lenses 13 are arranged on said auroral piece 5, the plano-convex lenses 13 are different in size and are irregular in shape, and the focal lengths of said plano-convex lenses 13 are different and the size thereof are smaller than the diameter of the condensing lenses 6.

Said shell assembly 1 includes an upper shell 14 and a bottom shell 15 arranged in combination from top to bottom wherein the top surface of said upper shell 14 is provided with an auroral through-hole 16 penetratingly and said auroral through-hole 16 and auroral cover 4 are used in a cooperative manner; the top surface of said upper shell 14 is provided with a laser through-hole 17 penetratingly, and said laser through-hole 17 and the laser assembly 3 are used in a cooperative manner.

Said laser assembly 3 includes a grating piece 18, a laser 19, and a laser radiator 20 provided from top to bottom wherein said grating piece 18 and the upper shell 14 are fixedly connected, said laser 19 and the laser radiator 20 are fixedly connected, and said laser radiator 20 and the upper shell 14 are fixedly connected.

A loudspeaker 21 is arranged on said bottom shell 15, and said loudspeaker 21 and the bottom shell 15 are fixed via screws.

A mainboard 22 is arranged on said bottom shell 15 wherein the mainboard 22 is electrically connected with the lamp beads 10, and is electrically connected with the laser 19, and is electrically connected with the loudspeaker 21.

When then invention is implemented, Firstly starting lamp beads 10 via mainboard 22, after lamp beads 10 is luminous, condensing light via the condensing lens (the condensing lens 6 can be spotlight cup lens, plano-convex lens, or spherical lens); after passing through plano-convex lens 13 on the auroral piece 5, irregular long-strip-shaped light spots are formed through the projection of irregular plano-convex lenses 11 on the auroral cover 4. Then, the auroral piece 5 is driven by the motor 9 to change the focal length of the irregular plano-convex lenses 13 above the condensing lens 6, and further change the focal length of the light passing through the auroral piece 5 via the condensing lens 6, so as to change irregular strip-shaped light bands and spots projected by the auroral cover 4, thus achieving the streamer effect Meanwhile, after the laser 19 emits light, the light is split through the grating piece 18 and passes through the laser through-hole 17, accordingly a plurality of small laser spots are formed on the projection background and are projected out to simulate stars. Meanwhile, the music played by the loudspeaker 21 is combined to restore the fantastic romantic scene of arctic starry sky.

The invention and its embodiments have been described above, but the description is not limited thereto; only one embodiment of the invention is shown in the drawings, and the actual structure is not limited thereto. In general, it is to be understood by those skilled in the art that non-creative design of structural forms and embodiments that are similar to the technical solutions without departing from the spirit of the invention shall all fall within the protective scope of the invention.

The invention claimed is:

1. A music arctic starry sky lamp comprising a shell assembly, an auroral assembly arranged in the shell assembly and a laser assembly arranged in the shell assembly;

said auroral assembly comprises an auroral cover, an auroral piece, a condensing lens, a lens mount, a substrate and a motor which are arranged from top to bottom, said auroral cover is fixedly connected with the shell assembly via screws; said condensing lens is fixedly connected with the lens mount, which is fixedly connected with the substrate; lamp beads are arranged on said substrate, and said motor is fixedly connected with the substrate, and an output end of said motor penetrates through the substrate and is fixedly connected with the auroral piece to drive the auroral piece;

a plurality of irregular plano-convex lenses are arranged on said auroral cover, the number of which is not less than ten, and not less than two thirds of the irregular plano-convex lenses are irregular long-strip-shaped lenses, and the length of the side edge of each irregular long-strip-shaped lens is more than two times of the width thereof;

a plurality of plano-convex lenses are arranged on said auroral piece, the plano-convex lenses are different in size and are irregular in shape, and the focal lengths of said plano-convex lenses are different and the size thereof are smaller than the diameter of the condensing lens.

2. The music arctic starry sky lamp of claim 1 wherein said shell assembly includes an upper shell and a bottom shell arranged in combination from top to bottom wherein the top surface of said upper shell is provided with an auroral through-hole penetratingly and said auroral through-hole and auroral cover are used in a cooperative manner; the top surface of said upper shell is provided with a laser through-hole penetratingly, and said laser through-hole and the laser assembly are used in a cooperative manner.

3. The music arctic starry sky lamp of claim 1 wherein said laser assembly includes a grating piece, a laser, and a laser radiator provided from top to bottom wherein said grating piece and the upper shell are fixedly connected, said laser and the laser radiator are fixedly connected, and said laser radiator and the upper shell are fixedly connected.

4. The music arctic starry sky lamp of claim 1 wherein a loudspeaker is arranged on said bottom shell, and said loudspeaker and the bottom shell are fixed via screws.

5. The music arctic starry sky lamp of claim 1 wherein a mainboard is arranged on said bottom shell wherein the mainboard is electrically connected with the lamp beads, and is electrically connected with the laser, and is electrically connected with the loudspeaker.

* * * * *